US011527231B1

(12) United States Patent
Haslam et al.

(10) Patent No.: US 11,527,231 B1
(45) Date of Patent: Dec. 13, 2022

(54) VOICE CANCELING HEADSET SYSTEM

(71) Applicant: UIPCO, LLC, San Antonio, TX (US)

(72) Inventors: Justin Dax Haslam, San Antonio, TX (US); Donnette L. Moncrief Brown, San Antonio, TX (US); Eric David Schroeder, San Antonio, TX (US); Ravi Durairaj, San Antonio, TX (US); Deborah Janette Schulz, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 0 days.

(21) Appl. No.: 17/707,012

(22) Filed: Mar. 29, 2022

Related U.S. Application Data

(63) Continuation of application No. 17/089,386, filed on Nov. 4, 2020, now Pat. No. 11,348,566.

(60) Provisional application No. 62/930,613, filed on Nov. 5, 2019.

(51) Int. Cl.

| | |
|---|---|
| ***G10K 11/178*** | (2006.01) |
| ***H04R 1/10*** | (2006.01) |
| ***H04R 1/08*** | (2006.01) |

(52) U.S. Cl.
CPC ..... *G10K 11/17873* (2018.01); *H04R 1/08* (2013.01); *H04R 1/1008* (2013.01); *G10K 2210/1081* (2013.01); *G10K 2210/3011* (2013.01); *G10K 2210/3044* (2013.01)

(58) Field of Classification Search
CPC ..... G10K 11/178; G10K 11/17827; G10K 11/17823; G10K 11/17881; G10K 2210/1081
See application file for complete search history.

(56) References Cited

U.S. PATENT DOCUMENTS 5,526,421 A * 6/1996 Berger ..... H04B 1/123 379/433.02

FOREIGN PATENT DOCUMENTS

JP 2018018042 A * 2/2018

* cited by examiner

*Primary Examiner* — Kile O Blair
(74) *Attorney, Agent, or Firm* — Plumsea Law Group, LLC

(57) ABSTRACT

A system and method for providing a headset system including a microphone including a microphone transducer configured to receive vocal sounds from a user of the headset system and to generate a voice audio signal representing the vocal sounds; a first earcup including a first housing, wherein the first housing further includes a voice canceling circuit, an inner speaker, and a first outer speaker; the voice canceling circuit configured to receive the voice audio signal and configured to generate a first voice canceling signal to cancel the voice of the user; and the first outer speaker including a first speaker transducer configured to generate and output sounds representing the first voice cancelling signal to cancel the vocal sounds of the user.

20 Claims, 9 Drawing Sheets

VOICE CANCELING HEADSET SYSTEM

CROSS-REFERENCE TO RELATED APPLICATIONS

This application is a continuation of U.S. patent application Ser. No. 17/089,386 filed Nov. 4, 2020 and titled "Voice Canceling Headset System," which application claims the benefit of U.S. Provisional Patent Application No. 62/930,613 filed Nov. 5, 2019, and titled "Voice Canceling Headset System," which applications are incorporated by reference herein in their entirety.

TECHNICAL FIELD

The present disclosure generally relates to methods and systems for reducing sound, and in particular to methods for making the sound of a human voice.

BACKGROUND

Many businesses frequently use call centers to handle interactions with incoming callers such as customers. For example, businesses use call centers to answer customer inquiries to respond to product or service inquiries to increase sales, facilitate payment of bills, and provide technical support for products and services already sold by businesses. Call centers may also be used for telemarketing, customer surveys, or collecting other information from customers. Businesses may also use call centers to communicate with suppliers or job applicants.

In a call center, there are several call center agents or large numbers of call center agents ready to answer incoming calls from incoming callers that wish to interact with a business. The incoming calls may be first placed in a queue and then answered by a call center agent. One or more call center agents may also be returning incoming calls at a later time because an incoming caller left a message or requested a return telephone call. By requesting a return telephone call, the incoming caller does not have to wait on hold.

Because there are numerous agents at a call center who sit next to each other to conserve space, the call center agents frequently wear headsets. These headsets include a speaker for each ear of the call center agent, so that the call center agent hears the voice of the incoming caller. These headsets also include a microphone so that the call center agent can speak into the microphone to responds to an incoming caller. However, these headsets do not filter out noise very well and so agents may have difficulty hearing a customer, or a customer may be distracted by the additional voices in the background of the call center.

There is a need in the art for a system and method that addresses the shortcomings discussed above.

SUMMARY

In one aspect, there is provided a headset system including a microphone including a microphone transducer configured to receive vocal sounds from a user of the headset system and to generate a voice audio signal representing the vocal sounds; a first earcup including a first housing, wherein the first housing further includes a voice canceling circuit, an inner speaker, and a first outer speaker; the voice canceling circuit configured to receive the voice audio signal and configured to generate a first voice canceling signal to cancel the voice of the user; and the first outer speaker including a first speaker transducer configured to generate and output sounds representing the first voice cancelling signal to cancel the vocal sounds of the user.

In another aspect, there is provided a voice canceling system including a voice canceling device, the voice canceling device including a microphone including a microphone transducer configured to receive a voice signal and to generate a voice audio signal representing the voice signal of the user; a voice canceling circuit configured to receive the voice audio signal and configured to generate a first voice canceling signal and a second voice canceling signal to cancel the voice of the user; a first outer speaker including a first speaker transducer configured to generate and output sounds representing the first voice canceling signal; and a second outer speaker including a second speaker transducer configured to generate and output additional sounds representing the second voice canceling signal.

In another aspect, there is provided a method for noise canceling including receiving through a microphone a voice signal from a user of a headset system; generating a voice audio signal representing the voice signal; generating a first voice canceling signal and a second voice canceling signal based upon the received voice audio signal using a processor; and outputting sounds representing the first voice cancelling signal and additional sounds representing the second voice canceling signal to cancel the voice of the user.

Other systems, methods, features, and advantages of the disclosure will be, or will become, apparent to one of ordinary skill in the art upon examination of the following figures and detailed description. It is intended that all such additional systems, methods, features, and advantages be included within this description and this summary, be within the scope of the disclosure, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DESCRIPTION OF EMBODIMENTS

Call centers handle interactions with incoming callers such as customers. In one or more embodiments, businesses may manage one or more call centers or hire an organization offering to manage one or more call centers for one or more businesses. An example of a business is an insurance provider. An insurance provider is only an example of a business, which uses one or more call centers. Many businesses use call centers or hire organizations, which manage call centers for businesses.

The embodiments provide a headset system to be worn by a call center agent that can cancel, or otherwise reduce, the agent's voice in the physical environment around the agent. The headset system outputs sounds representing one or more voice canceling signals through one or more speakers into the air outside the headset system to mask the voice of the call center agent. In one or more embodiments, call center agents using these headset systems do not hear the voices of their colleagues near each other, because the sounds of their voices are canceled by their respective headsets.

Accordingly, one or more embodiments provide headset systems and methods for reducing the voice of a user of a headset system. The user of the headset system may be wearing the headset system. Although the embodiments describe the use of this headset system in call centers, the headset system can be worn by any other user to obtain the benefits of cancellation of the user's voice shortly after the user speaks into the microphone of the headset system.

Figure 1:
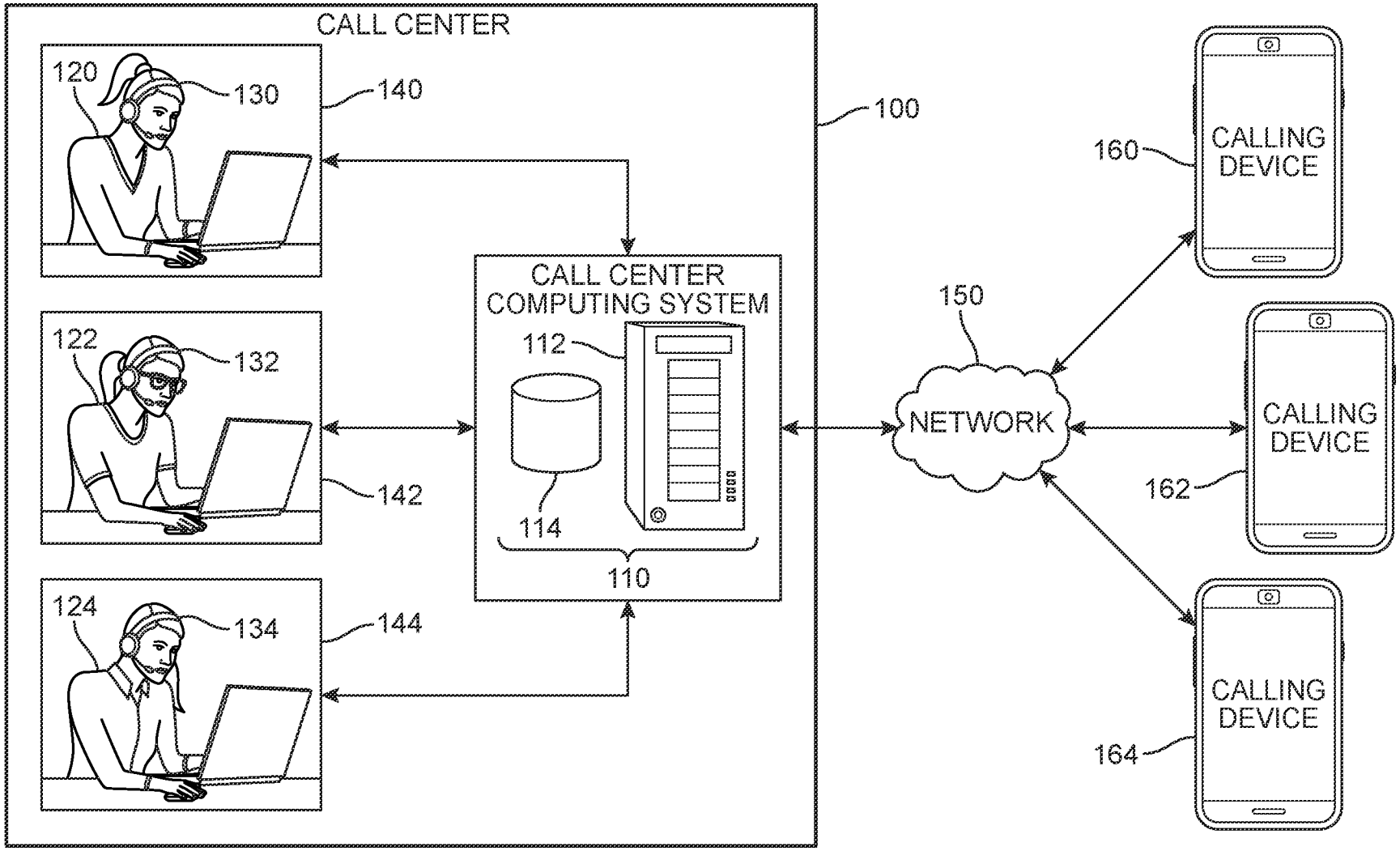
FIG. 1 is a schematic view of a call center according to an embodiment.

FIG. 1 is a schematic view of a call center according to an embodiment. Referring to FIG. 1, one or more calling devices may communicate with a call center 100 through a network 150. For example, a first calling device 160, a second calling device 162, and a third calling device 164 may communicate through a network 150 with a call center 100. Each calling device may be used by a customer trying to speak with an agent in call center 100. In different embodiments, the type of network used could vary. In some cases, the network 150 may be the Internet. In some cases, the network 150 may be a telephone network. The network 150 may be the Internet communicating with a telephone network such as packet switching telephone network (PSTN), which communicates with one or more calling devices. The network 150 may be the Internet communicating with a wireless network, which communicates with one or more calling devices. The network 150 may be an Internet Protocol (IP) telephone network.

The call center 100 may include a call center computing system 110. The term "computing system" refers to the computing resources of a single computer, the partial computing resources of a single computer, a plurality of computers communicating with one another, or a network of servers. The "computing system" may also be a "cloud computing system." In an exemplary embodiment, a computing system, may include at least one server.

In one or more embodiments, the call center computing system 110 may include at least one computing device 112. The call center computing system 110 includes one or more computing devices 112 (for example, a server) that may be in communication with one or more databases 114 (memories). A computing device 112 may include one or more processors and a non-transitory computer readable medium. Instructions stored on the non-transitory computer readable medium may be executed by the one or more processors. Databases 114 could be co-located with computing device 112 or could be remote databases that are accessible by computing device 112 over network 150. Databases 114 can include any kind of storage devices, including but not limited magnetic, optical, magneto-optical, and/or memory, including volatile memory and non-volatile memory.

In one or more embodiments, the call center 100 further includes workstations. These workstations may be computing devices, which are connected to a call center computing system 110. In one or more embodiments, call center agents sit at workstations and use headset systems. In one or more embodiments, each call center agent wears the headset system and speaks into a microphone of the headset system. The microphone of the headset may be positioned near the mouth of the call center agent. For example, FIG. 1 shows a first agent 120 wearing a first headset system 130 at a first workstation 140. FIG. 1 shows a second agent 122 wearing a second headset system 132 at a second workstation 142. FIG. 1 also shows a third agent 124 wearing a third headset system 134 at a third workstation 144.

The first agent 120, the first headset system 130, and the first workstation 140 provide examples which may be used for other agents, headsets, and workstations. For example, in some embodiments, a first headset system 130 receives a first voice of the first agent 120 through a microphone. The first headset system 130 may wirelessly communicate with the first workstation 140 using one or more wireless technologies including cellular, Bluetooth, WIFI, personal area network, near field communications. The first headset system 130 may also be communicating with the first workstation 140 using a wired system. The first workstation 140 may communicate with the call center computing system 110 using wired or wireless technology.

Alternatively, one or more headset systems may be wirelessly communicating with a call center computing system 110 using various wireless technologies including cellular, Bluetooth, WIFI, personal area network, near communications. One or more headset systems may also be communicating with a call center computing system 110 by using a wired system.

Figure 2:
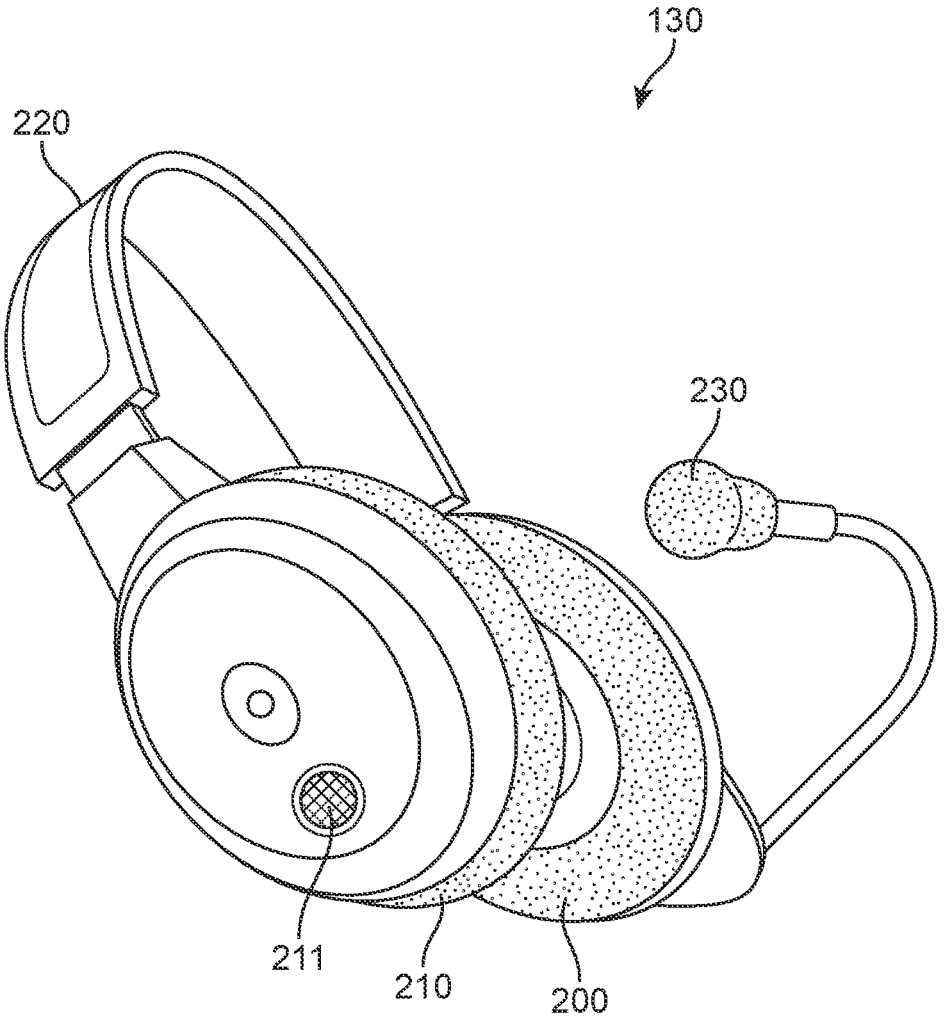
FIG. 2 is a perspective view of a headset system according to an embodiment.

FIG. 2 is a perspective view of a headset system according to an embodiment. For example, the headset system may be headset system 130 shown in FIG. 1. In this example, the headset system 130 may include a first earcup 200 connected to a second earcup 210 by a band 220. This may be referred to as a dual-earcup configuration. The first earcup 200 may be connected to a microphone 230. In this example, the headset system 130 may include wireless technology to communicate with the workstation 140.

As described in further detail below, headset system 130 may include one or more speakers. For example, headset system 130 can include speakers disposed on an inner side of the ear cups (not visible in FIG. 2). These inner speakers are disposed close to the ears when headset system 130 is worn and convey the sounds of the speaker on the other end of the call. Additionally, the present embodiment can incorporate one or more outer speakers. For purposes of illustration, a single outer speaker 211 is shown on second earcup 210 in FIG. 2. It may be appreciated that another outer speaker may also be disposed on an outer side of first earcup 200. By contrast with the inner speakers, which convey sounds from a phone call that the user of the headset system is engaged in, the outer speakers are configured to generate sounds that can be used to cancel, or substantially reduce, the sound of the user's voice as it would be heard by other people in the environment.

Figure 3:
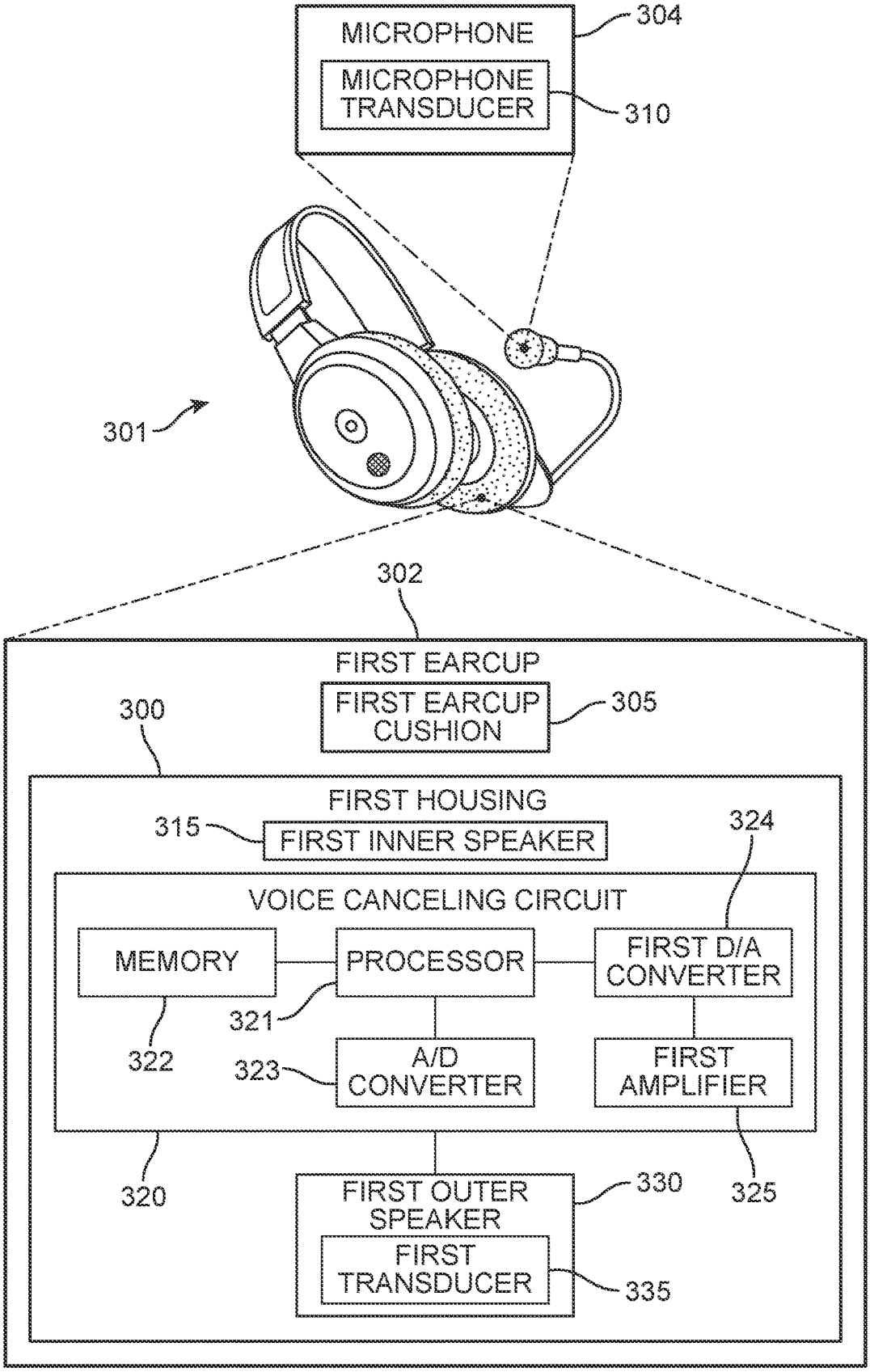
FIG. 3 is a schematic view of an embodiment of a first ear cup of a headset system according to an embodiment.

FIG. 3 is a schematic view of another embodiment of headset system 301. In this embodiment, only a first earcup 302 of headset system 301 includes an outer speaker. The first earcup 200 includes a first housing 300 and a first earcup cushion 305, which fits over one of the ears of the first agent 120. In this example, the first earcup 200 is connected to a microphone 304, which includes a microphone transducer 310. At least one circuit component in the housing 300 of the first earcup 200 is electrically connected to the microphone 304. In this example, first agent 120 may position the microphone 304, so that the microphone 304 is near the mouth of the first agent 120. The microphone 304 is configured to receive a voice signal (voice) from the first agent 120. The microphone transducer 310 generates a voice audio signal based on the voice signal of the first agent 120. The voice audio signal may be an analog voice audio signal. In this example, the first housing 300 includes a first inner speaker 315 which outputs voice signals from network 150 to an ear of the first agent 120.

In one or more embodiments, the first housing 300 includes a voice canceling circuit 320 configured to receive the voice audio signal and generate a first voice canceling signal to mask the voice of the first agent 120. The first agent 120 is a user of the first headset system 130. A first outer speaker 330 including a first speaker transducer 335 receives the first voice canceling signal from the voice canceling circuit 320. The first speaker transducer 335 generates and outputs sounds representing the first voice canceling signal to cancel the voice (vocal sounds) of the first agent 120 previously received by the microphone 304. The first voice canceling signal may have the same amplitude and frequency as the voice audio signal. In order to cancel the voice audio signal, however, the first voice canceling signal may differ from the voice audio signal by approximately one hundred eighty degrees in phase. By canceling the voice audio signal of the first agent 120, other agents including the second agent 130 and the third agent 140 may be less distracted by the voice of the first agent 120.

In some embodiments, the voice canceling circuit 320 may include processor 321 communicating with a memory 322. In some embodiments, a processor 321 may be a central processing unit. The memory 322 may include instructions for performing operations of the voice canceling circuit 320. The processor 321 may be connected to an A/D converter 323. The A/D converter 323 may receive the analog voice audio signal from the microphone 304. The A/D converter 323 may convert the analog voice audio signal to a digital audio voice signal. In some embodiments, the processor 321 may convert the digital audio voice signal into a first digital voice canceling signal. The processor 321 may send the first digital voice canceling signal to a first digital to analog converter 324. The first digital to analog converter 324 may convert the first digital voice canceling signal to a first analog voice canceling signal. The first digital to analog converter 324 may send the first analog voice canceling signal to an amplifier 325. The amplifier 325 may amplify the first analog voice canceling signal to output a first voice canceling signal. The first outer speaker 330 including a first speaker transducer 335 may convert the received first voice canceling signal into sounds representing the first voice canceling signal to cancel the vocal sounds (voice) of the first agent 120.

In some embodiments, the voice canceling circuit 320 may be an application specific integrated circuit (ASIC), which include circuit elements that perform the same or similar functions as discussed above to receive the voice audio signal and generate the first voice canceling signal sent to the first outer speaker 330. The first outer speaker 330 may direct sounds representing the first voice canceling signal away from the headset system 130.

Figure 4:
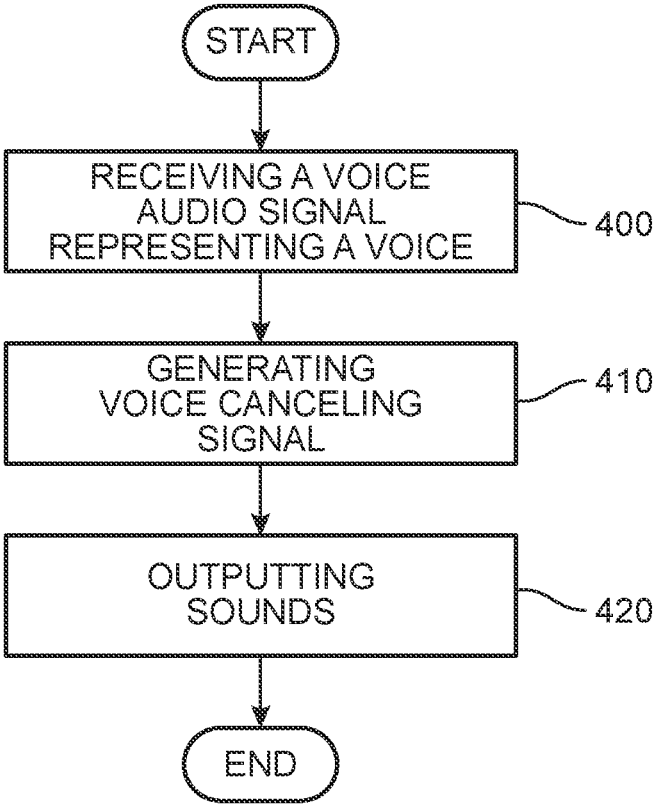
FIG. 4 is a schematic view of a process for voice canceling of a voice spoken by a user of a headset system according to an embodiment.

FIG. 4 is a schematic view of a process for voice canceling of a voice spoken by a user of a headset system according to an embodiment. A voice signal (voice) may be received through a microphone such as the microphone 230 shown in FIG. 2 and FIG. 3. As discussed above, the microphone 230 includes a microphone transducer 310, which may convert a voice signal into a voice audio signal. In operation 400, the voice audio signal may be received by a voice canceling circuit such as voice canceling circuit 320 in FIG. 3. The voice canceling circuit 320 shown in FIG. 3 is one example of a voice canceling circuit. In operation 410, a voice canceling signal may be generated by the voice canceling circuit 320 based upon the received voice audio signal representing a voice. In operation 420, the speaker may output sounds representing the voice canceling signal away from the headset system to cancel the voice (vocal sounds) inputted in the microphone, such as microphone 230. The voice canceling signal may have the same amplitude and frequency as the voice audio signal. The voice canceling signal may differ from the voice audio signal by approximately one hundred eighty degrees in phase. By outputting the sounds representing the voice canceling signal, this prevents the voice from being a distraction to others located near the user.

In another embodiment, a separate outer speaker may be provided in each ear cup. This allows voice canceling sounds to be emitted in multiple directions. If two people are located on either side of a call agent using a voice canceling headset with two speakers, the voice canceling sounds may be emitted by each speaker so that they reach the two people in similar times and with similar amplitudes.

Figure 5:
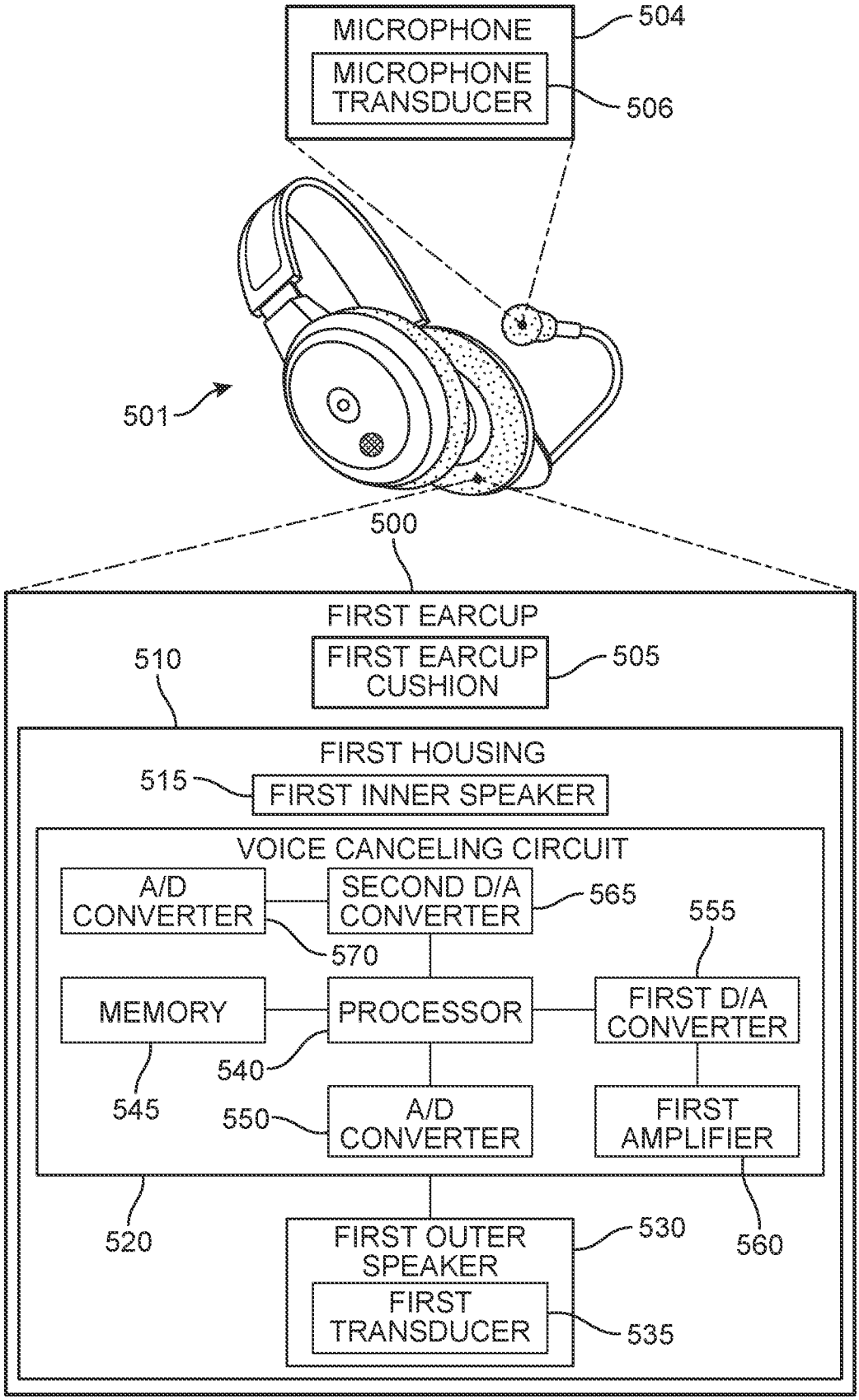
FIG. 5 is a schematic view of an embodiment of a first ear cup of a headset system according to an embodiment.

FIG. 5 is a schematic view of an embodiment of a first ear cup of a headset system 501 according to an embodiment. For example, the first agent 120 is a user of the first headset system 130. In some embodiments, the first headset system 130 may have a first earcup 500. The first earcup 500 may include a first earcup cushion 505, which fits over one of the ears of the first agent 120. The first earcup 500 further includes a first housing 510. In this example, the first earcup 500 is connected to the microphone 504, which includes a microphone transducer 504. At least one circuit component in the first housing 510 of the first earcup 500 is electrically connected to the microphone 504. In this example, first agent 120 may position the microphone 504, so that the microphone 504 is near the mouth of the first agent 120. The microphone 5040 is configured to receive a voice signal (voice) from the first agent 120. The microphone transducer 506 generates a voice audio signal based on the voice signal of the first agent 120. The voice audio signal may be an analog voice audio signal. In this example, the first housing 510 includes a first inner speaker 515 which outputs voice signals from network 150 to an ear of the first agent 120

In one or more embodiments, the first housing 510 includes a voice canceling circuit 520 configured to receive the voice audio signal and generate a first voice canceling signal and a second voice canceling signal to cancel the voice (voice signal) of the first agent 120. The first agent 120 is a user of the first headset system 130. A first outer speaker 530 including a first speaker transducer 535 receives the first voice canceling signal from the voice canceling circuit 520. The first speaker transducer 535 generates and outputs sounds representing the first voice canceling signal to cancel the voice of the first agent 120 previously received by the microphone 504. A second outer speaker in a second earcup, including a second speaker transducer, receives a second voice canceling signal from voice canceling circuit 520. The second speaker transducer generates and outputs additional sounds representing the second voice canceling signal to cancel the voice of the first agent 120 previously received by the microphone 230.

The first voice canceling signal and the second voice canceling signal may have the same amplitude and frequency as the voice audio signal. The first voice canceling signal and the second voice canceling signal may differ from the voice audio signal by one hundred eighty degrees in phase. The second earcup is not shown in FIG. 5. Instead, some embodiments of second earcups will be discussed later with reference to FIG. 6 and FIG. 7. By outputting the sounds representing the first voice canceling signal and outputting the additional sounds representing the second voice canceling signal, other agents including the second agent 130 and the third agent 140 as well as other agents are not be distracted by the voice of the first agent 120.

In some embodiments, the voice canceling circuit 520 may include processor 540 communicating with a memory 545. In some embodiments, a processor 540 may be a central processing unit. The memory 545 may include instructions for performing operations of the voice canceling circuit 520. The processor 540 may be connected to an A/D converter 550. The A/D converter 550 may receive the analog voice audio signal from the microphone 504. The A/D converter 550 may convert the analog voice audio signal to a digital audio voice signal. In some embodiments, the processor 540 may convert the digital audio voice signal into a first digital voice canceling signal and a second digital voice canceling signal. The processor 540 may send the first digital voice canceling signal to a first digital to analog converter 555. The first digital to analog converter 555 may convert the first digital voice canceling signal to a first analog voice canceling signal. The first digital to analog converter 555 may send the first analog voice canceling signal to a first amplifier 560. The first amplifier 560 may amplify the first analog voice canceling signal to output the first voice canceling signal. The first outer speaker 530, including a first speaker transducer 535, may output sounds representing the first voice canceling signal to cancel the voice of the first agent 120.

The processor 540 may send the second digital voice canceling signal to a second digital to analog converter 565. The second digital to analog converter 565 may convert the second digital voice canceling signal to a second analog voice canceling signal. The second digital to analog converter 565 may send the second analog voice canceling signal to a second amplifier 570. The second amplifier 570 may amplify the second analog voice canceling signal to output the second voice canceling signal to a second earcup.

In some embodiments, the voice canceling circuit 520 may be an application specific integrated circuit (ASIC), which include circuit elements that perform the same or similar functions as discussed above to receive the audio voice signal and generate the first voice canceling signal and the second voice canceling signal.

Figure 6:
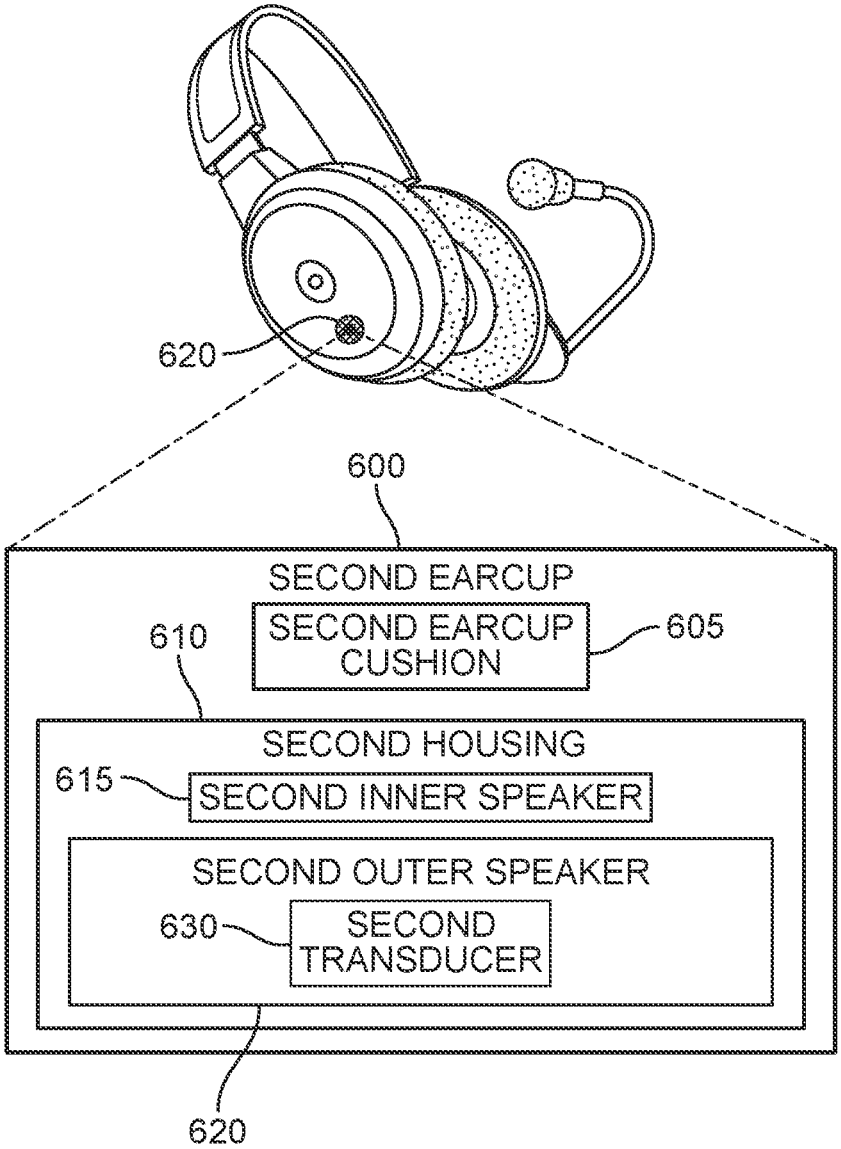
FIG. 6 is a schematic view of an embodiment of a second ear cup of a headset system according to an embodiment.

FIG. 6 is a schematic view of an embodiment of a second ear cup of a headset system according to an embodiment. In some embodiments, FIG. 6 shows a second earcup 600 including a second earcup cushion 605 and a second housing 610. In this example, the second housing 610 includes a second inner speaker 615 which outputs voice signals from the network 150 to an ear of the first agent 120. The second housing 610 includes a second speaker 620. The second speaker 620 includes a second speaker transducer 630. The second speaker transducer 630 receives the second voice canceling signal. The second speaker transducer 630 generates and outputs additional sounds representing the second voice canceling signal to cancel the voice of the first agent 120 previously received by the microphone 504. The second voice canceling signal may have the same amplitude and frequency as the voice audio signal. The second voice canceling signal may differ from the voice audio signal by one hundred eighty degrees in phase. By canceling the voice of the first agent 120, other agents including the second agent 130 and the third agent 140 are not be distracted by the voice of the first agent 120.

Figure 7:
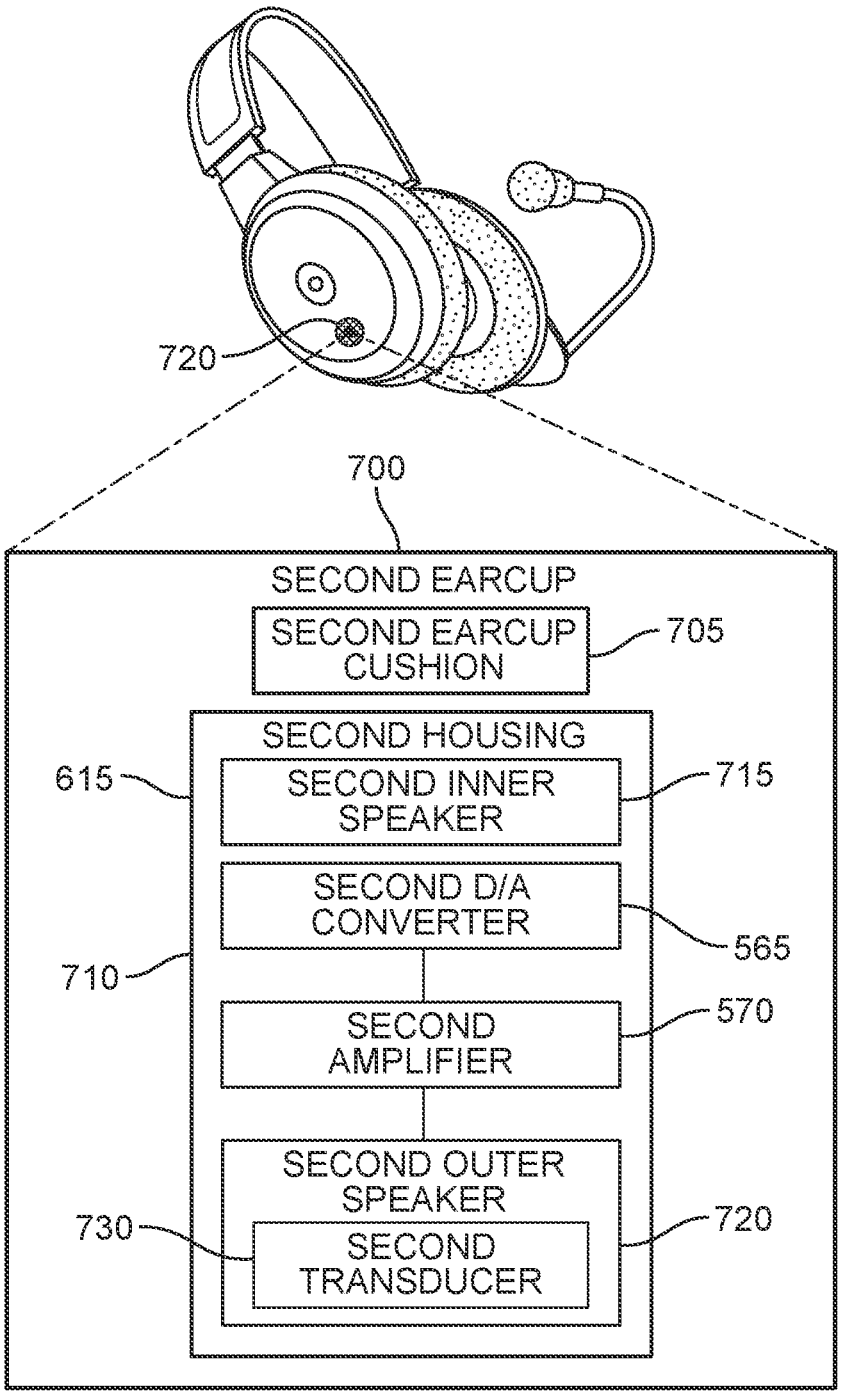
FIG. 7 is a schematic view of an embodiment of a second ear cup of a headset system according to an embodiment.

FIG. 7 is a schematic view of an embodiment of a second ear cup of a headset system according to an embodiment. In the exemplary embodiment in FIG. 7, an earcup 700 includes an earcup cushion 705 and an earcup housing 710. In this example, the second housing 710 includes a second inner speaker 715 which outputs voice signals from network 150 to an ear of the first agent 120. In FIG. 5, second digital to analog converter 565 and the second amplifier 570 are positioned in the first housing 510. In an alternative embodiment shown in FIG. 7, the digital to analog converter 565 and the second amplifier 570 are positioned in the second housing 710. However, the digital analog converter 565 and the second amplifier 570 remain a part of the voice canceling circuit 520 and the second amplifier 570 outputs the second voice canceling signal. A second speaker 720 in the second earcup housing 710 receives the second voice canceling signal.

The second speaker 720 includes a second speaker transducer 730. The second speaker transducer 730 receives the second voice canceling signal. The second speaker transducer 730 generates and outputs additional sounds representing the second voice canceling signal to cancel the voice of the first agent 120 previously received by the microphone 504. The second voice canceling signal may have the same amplitude and frequency as the voice audio signal. The second voice canceling signal may differ from the voice audio signal by approximately one hundred eighty degrees in phase. By canceling the voice of the first agent 120, other agents including the second agent 130 and the third agent 140 are not be distracted by the voice of the first agent 120.

Figure 8:
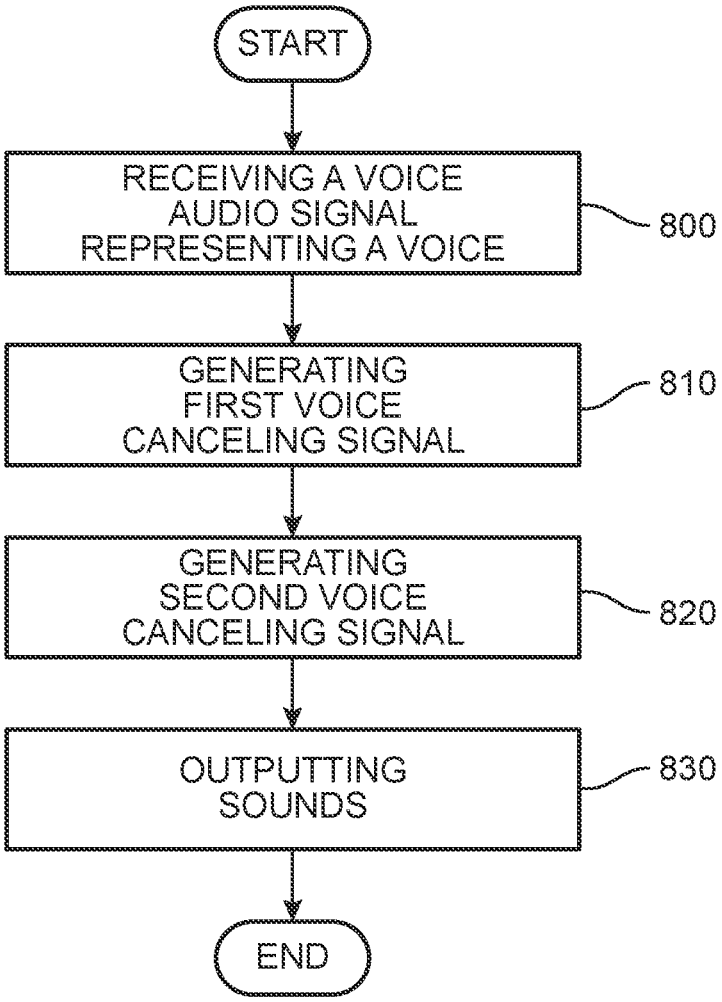
FIG. 8 is a schematic view of a process for voice canceling of a voice spoken by a user of a headset system according to an embodiment.

FIG. 8 is a schematic view of a process for voice canceling of a voice spoken by a user of a headset system according to an embodiment. A voice signal (voice) may be received through a microphone such as the microphone 230 shown in FIG. 2 and FIG. 3. As discussed above, the microphone 230 includes a microphone transducer 310, which may convert a voice signal (voice) into a voice audio signal. In operation 800, the voice audio signal may be received by a voice canceling circuit such as voice canceling circuit 520 in FIG. 5. The voice canceling circuit 520 shown in FIG. 5 is one example of a voice canceling circuit. In operation 810, a first voice canceling signal may be generated by the voice canceling circuit 520 based upon the received voice audio signal. In operation 820, a second voice canceling signal may be generated by the voice canceling circuit 520 based upon the received voice audio signal. In operation 830, the first speaker may output sounds representing the first voice canceling signal away from the headset system and the second speaker may output sounds representing the second voice canceling signal away from the headset system to cancel the voice (voice signal) received a microphone, such as microphone 230. The first voice canceling signal and the second voice canceling signal may have the same amplitude and frequency as the voice audio signal. The first voice canceling signal and the second voice canceling signal may differ from the voice audio signal by one hundred eighty degrees in phase. By outputting the sounds representing the first voice canceling signal and outputting the sounds representing the second voice canceling, this prevents the voice from being a distraction to others located near the user.

Figure 9:
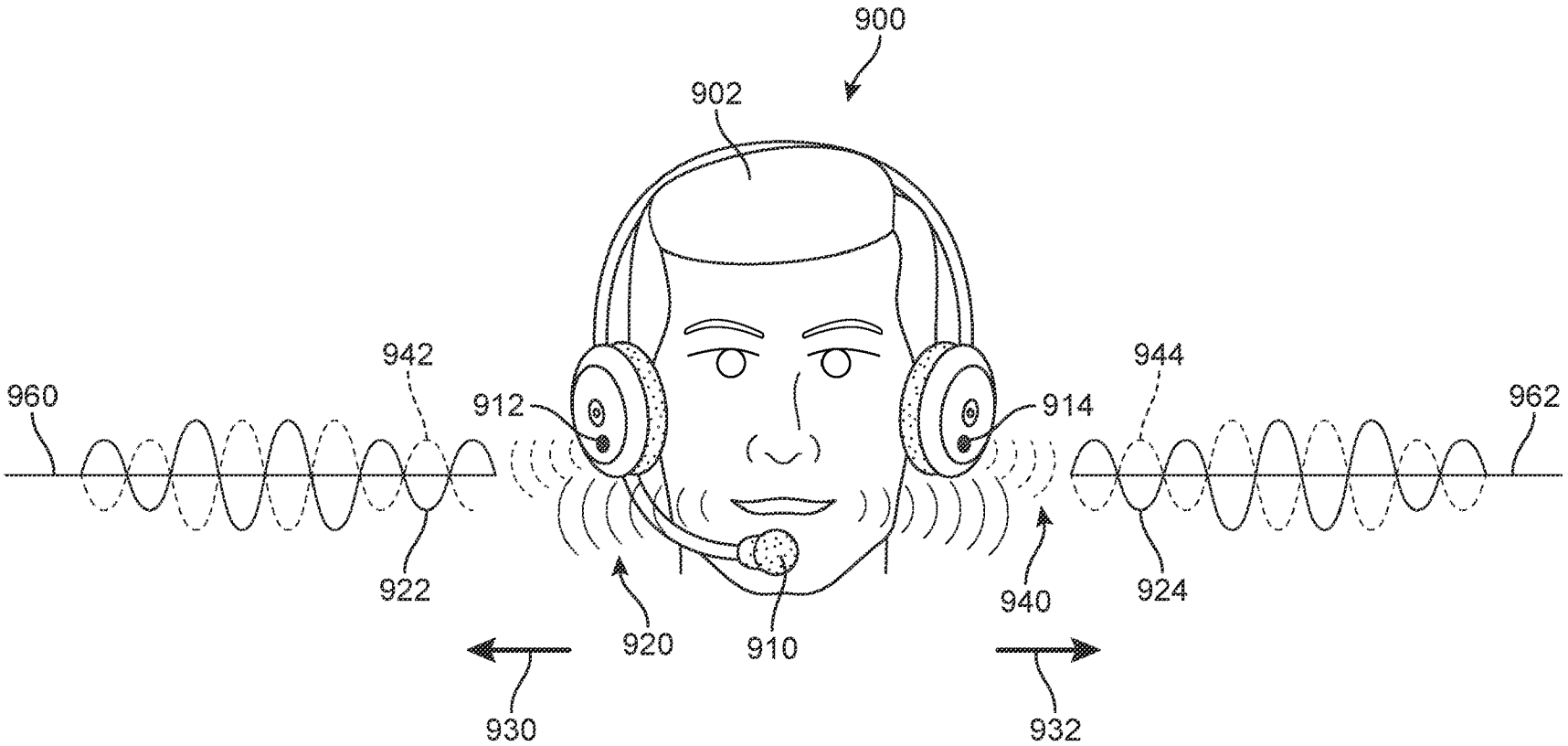
FIG. 9 is a schematic view of a headset system being used to cancel a user's voice, according to an embodiment.

FIG. 9 shows a schematic view of the voice cancellation process during use. As shown in FIG. 9, a user 902 is wearing a headset system 900 that uses the voice cancelling technology described above. Headset system 900 is further seen to comprise a microphone 910, a first external speaker 912 and a second external speaker 914. As user 902 speaks, sounds 920 travel out from his mouth in at least two directions (first direction 930 and second direction 932). Sounds 920 are identified with a first soundwave 922 moving in first direction 930 and second soundwave 924 moving in second direction 932.

Sounds 920 are also captured by microphone 910. Using the process described in detail above, headset system 900 generates a voice canceling signal, which is emitted as voice canceling sounds 940. Voice canceling sounds 940 are identified with a first voice canceling sound wave 942, which is emitted from first external speaker 912 and moving in first direction 930. Voice canceling sounds 940 are also associated identified with a second voice canceling sound wave 944, which is emitted from second external speaker 914 and moves in second direction 932. As shown in FIG. 9, the first voice canceling sound wave 942 cancels with first soundwave 922 to produce a first canceled soundwave 960. Likewise, the second voice canceling sound wave 944 cancels with second soundwave 924 to produce a second canceled soundwave 962.

It may be appreciated that the above systems and methods may apply not only to headsets used in call centers but also to any headset or device for voice cancelation of a human voice, and any computing device and any network may be used to implement the above systems and methods. It is also understood that various icons can be displayed on the display of the mobile computing device or other computing devices implementing the methods and systems in embodiments.

The processes and methods of the embodiments described in this detailed description and shown in the figures can be implemented using any kind of computing system having one or more central processing units (CPUs) and/or graphics processing units (GPUs). The processes and methods of the embodiments could also be implemented using special purpose circuitry such as an application specific integrated circuit (ASIC). The processes and methods of the embodiments may also be implemented on computing systems including read only memory (ROM) and/or random access memory (RAM), which may be connected to one or more processing units. Examples of computing systems and devices include, but are not limited to: servers, cellular phones, smart phones, tablet computers, notebook computers, e-book readers, laptop or desktop computers, all-in-one computers, as well as various kinds of digital media players.

The processes and methods of the embodiments can be stored as instructions and/or data on non-transitory computer-readable media. The non-transitory computer readable medium may include any suitable computer readable medium, such as a memory, such as RAM, ROM, flash memory, or any other type of memory known in the art. In some embodiments, the non-transitory computer readable medium may include, for example, an electronic storage device, a magnetic storage device, an optical storage device, an electromagnetic storage device, a semiconductor storage device, or any suitable combination of such devices. More specific examples of the non-transitory computer readable medium may include a portable computer diskette, a floppy disk, a hard disk, magnetic disks or tapes, a read-only memory (ROM), a random access memory (RAM), a static random access memory (SRAM), a portable compact disc read-only memory (CD-ROM), an erasable programmable read-only memory (EPROM or Flash memory), electrically erasable programmable read-only memories (EEPROM), a digital versatile disk (DVD and DVD-ROM), a memory stick, other kinds of solid state drives, and any suitable combination of these exemplary media. A non-transitory computer readable medium, as used herein, is not to be construed as being transitory signals, such as radio waves or other freely propagating electromagnetic waves, electromagnetic waves propagating through a waveguide or other transmission media (e.g., light pulses passing through a fiber-optic cable), or electrical signals transmitted through a wire.

Instructions stored on the non-transitory computer readable medium for carrying out operations of the present invention may be instruction-set-architecture (ISA) instructions, assembler instructions, machine instructions, machine dependent instructions, microcode, firmware instructions, configuration data for integrated circuitry, state-setting data, or source code or object code written in any of one or more programming languages, including an object oriented programming language such as Smalltalk, C++, or suitable language, and procedural programming languages, such as the "C" programming language or similar programming languages.

Aspects of the present disclosure are described in association with figures illustrating flowcharts and/or block diagrams of methods, apparatus (systems), and computing products. It will be understood that each block of the flowcharts and/or block diagrams can be implemented by computer readable instructions. The flowcharts and block diagrams in the figures illustrate the architecture, functionality, and operation of possible implementations of various disclosed embodiments. Accordingly, each block in the flowchart or block diagrams may represent a module, segment, or portion of instructions. In some implementations, the functions set forth in the figures and claims may occur in an alternative order than listed and/or illustrated.

The embodiments may utilize any kind of network for communication between separate computing systems. A network can comprise any combination of local area networks (LANs) and/or wide area networks (WANs), using both wired and wireless communication systems. A network may use various known communications technologies and/or protocols. Communication technologies can include, but are not limited to: Ethernet, 802.11, worldwide interoperability for microwave access (WiMAX), mobile broadband (such as CDMA, and LTE), digital subscriber line (DSL), cable internet access, satellite broadband, wireless ISP, fiber optic internet, as well as other wired and wireless technologies. Networking protocols used on a network may include transmission control protocol/Internet protocol (TCP/IP), multiprotocol label switching (MPLS), User Datagram Protocol (UDP), hypertext transport protocol (HTTP) and file transfer protocol (FTP) as well as other protocols.

Data exchanged over a network may be represented using technologies and/or formats including hypertext markup language (HTML), extensible markup language (XML), Atom, JavaScript Object Notation (JSON), YAML, as well as other data exchange formats. In addition, information transferred over a network can be encrypted using conventional encryption technologies such as secure sockets layer (SSL), transport layer security (TLS), and Internet Protocol security (Ipsec).

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. A system for voice canceling in a physical environment, comprising:

a physical environment including a plurality of users co-located in the physical environment;

wherein one or more users of the plurality of users in the physical environment wears a headset system, the headset system comprising:

a microphone including a microphone transducer configured to receive vocal sounds from a user of the headset system and to generate a voice audio signal representing the vocal sounds;

a first earcup including a first housing, wherein the first housing further includes a voice canceling circuit, an inner speaker, and a first outer speaker;

the voice canceling circuit configured to receive the voice audio signal and configured to generate a first voice canceling signal and a second voice canceling signal to cancel the voice of the user;

the first outer speaker including a first speaker transducer configured to generate and output sounds representing the first voice canceling signal to cancel the vocal sounds of the user; and a second earcup including a second housing, wherein the second housing further includes a second inner speaker and a second outer speaker, the second outer speaker including a second speaker transducer configured to generate and output sounds representing the second voice canceling signal to cancel the vocal sounds of the user.

2. The system according to claim 1, wherein the headset system is configured to cancel the voice of the user adjacent to at least one other user of the plurality of users in the physical environment.

3. The system according to claim 1, wherein the physical environment is a call center; and wherein the plurality of users is a plurality of call center agents.

4. The system according to claim 1, wherein the headset system of each user of the plurality of users is configured to communicate with an associated workstation of the user.

5. The system according to claim 4, wherein the physical environment includes a computing system; and wherein the workstation of each user of the plurality of users is in communication with the computing system.

6. The system according to claim 1, wherein:

the first voice canceling signal has a same amplitude and frequency as the voice audio signal; and the voice audio signal differs from the first voice canceling signal by about one hundred eighty degrees in phase to mask the vocal sounds of the user.

7. The system according to claim 1, wherein the headset system further comprises a second earcup including a second housing including a second outer speaker, wherein the second speaker transducer is disposed further from the microphone than the second inner speaker disposed within a second earcup.

8. The system according to claim 7, wherein the second outer speaker includes a second speaker transducer configured to generate and output additional sounds extending in a second direction different than a first direction associated with the first speaker transducer.

9. The system according to claim 1, wherein:

the first voice canceling signal and the second voice canceling signal have a same amplitude and a same frequency as the voice audio signal; and the voice audio signal differs from the first voice canceling signal and the second voice canceling signal by about one hundred eighty degrees in phase to cancel the vocal sounds of the user.

10. The system according to claim 1, wherein the microphone is connected to the first housing of the first earcup.

11. A method for voice canceling in a physical environment including a plurality of users, comprising:

providing one or more users of the plurality of users co-located in the physical environment with a headset system;

receiving through a microphone, for each user of the one or more users, a voice signal from the user of the headset system;

generating a voice audio signal representing the voice signal;

generating a first voice canceling signal and a second voice canceling signal based upon the received voice audio signal using a processor;

outputting sounds representing the first voice cancelling signal and additional sounds representing the second voice canceling signal to cancel the voice of the user;

wherein the first voice canceling signal extends in a first direction and the second voice canceling signal extends in a second direction, the second direction being different than the first direction; and wherein the first voice canceling signal and the second voice canceling signal cancels the voice of the user in their respective directions.

12. The method according to claim 11, further comprising canceling the voice of the user of the headset system adjacent to at least one other user of the plurality of users in the physical environment.

13. The method according to claim 11, wherein the physical environment is a call center; and wherein the plurality of users is a plurality of call center agents.

14. The method according to claim 11, further comprising:

the headset system of each user of the one or more users communicating with an associated workstation of the user.

15. The method according to claim 14, wherein the physical environment includes a computing system; and wherein the workstation of each user of the plurality of users is in communication with the computing system.

16. The method according to claim 11, wherein:

the first voice canceling signal and the second voice canceling signal have a same amplitude and a same frequency as the voice audio signal; and the voice audio signal differs from the first voice canceling signal and the second voice canceling signal by about one hundred eighty degrees in phase to cancel the voice of the user.

17. The method according to claim 11, further comprising converting the received voice audio signal to a digital audio voice signal using an analog to digital converter.

18. The method according to claim 17, wherein generating the first voice canceling signal and the second voice canceling signal comprises:

generating a first digital voice canceling signal and a second digital voice canceling signal based on the digital audio voice signal;

converting the first digital voice canceling signal to a first analog voice canceling signal; and converting the second digital voice canceling signal to a second analog voice canceling signal.

19. The method according to claim 18, wherein generating the first voice canceling signal and the second voice canceling signal further comprises:

amplifying the first analog voice canceling signal to generate the first voice canceling signal; and amplifying the second analog voice canceling signal to generate the second voice canceling signal.

20. The method according to claim 11, wherein the plurality of users includes a first user, a second user, and a third user;

wherein the second user and the third user are adjacent to the first user in the physical environment;

a first headset worn by the first user cancels a voice of the first user from being heard by either the second user or the third user.

* * * * *